United States Patent [19]

Truxell

[11] Patent Number: 5,056,155

[45] Date of Patent: Oct. 15, 1991

[54] BUCKLER/SHIELD FOR MELEE FIGHTING

[76] Inventor: Leland C. Truxell, R.D. 5, Box 249, Danville, Pa. 17821

[21] Appl. No.: 559,150

[22] Filed: Jul. 26, 1990

[51] Int. Cl.[5] ..... F41H 5/08

[52] U.S. Cl. ..... 2/2; 2/2.5; 89/36.05; 109/49.5

[58] Field of Search ..... 2/2, 2.5, 16; 89/36.05; 109/49.5, 58.5; 224/219, 221, 222, 267; 446/26, 473

[56] References Cited

U.S. PATENT DOCUMENTS

| | | | |
|---|---|---|---|
| D. 132,468 | 5/1942 | Leuer | 89/36.05 |
| 1,250,197 | 12/1917 | Louppe | 109/49.5 |
| 1,466,669 | 9/1923 | Martinson | 2/2.5 |
| 1,895,197 | 1/1933 | Martinson | 109/49.5 |
| 2,020,702 | 11/1935 | Russell | 2/2.5 |
| 2,316,055 | 4/1943 | Davey | 89/36.05 |
| 2,749,000 | 6/1956 | McKiltrick | 224/218 |
| 2,820,318 | 1/1958 | Guyer | 2/2.5 X |
| 3,040,942 | 6/1962 | Cote | 224/218 |
| 3,370,302 | 2/1968 | Karlyn | 89/36.05 |
| 3,745,938 | 7/1973 | Hathaway et al. | 109/58.5 X |
| 4,246,944 | 1/1981 | Dixie | 224/218 |
| 4,285,530 | 8/1981 | Ducourant | 109/49.5 X |
| 4,412,495 | 11/1983 | Sankar | 89/36.05 X |
| 4,674,394 | 6/1987 | Martino | 109/49.5 X |
| 4,843,947 | 7/1989 | Bauer | 89/36.05 |
| 4,913,326 | 4/1990 | Echelson | 224/222 |
| 4,919,037 | 4/1990 | Mitchell | 224/218 X |

FOREIGN PATENT DOCUMENTS

| | | | |
|---|---|---|---|
| 544769 | 4/1942 | United Kingdom | 2/2.5 |
| 2209820 | 5/1989 | United Kingdom | 89/36.05 |
| 2221286 | 1/1990 | United Kingdom | 89/36.05 |

*Primary Examiner*—Werner H. Schroeder
*Assistant Examiner*—Jeanette E. Chapman
*Attorney, Agent, or Firm*—Arthur R. Eglington

[57] ABSTRACT

A protective shield assembly for a melee combatant having a planar surface and an elongated unitary body with a contoured periphery. Both the upper and lower segments have a generally triangular configuration with the apexes pointing outwardly. The reverse side of the shield is provided with a spaced apart manually grippable handle and a forearm supporting sleeve-like boot. A depending tail on the lower segment adds enhanced body defenses and confers an aggesssive component to the shield allowing extended bashing moves against an opponent.

9 Claims, 2 Drawing Sheets

BUCKLER/SHIELD FOR MELEE FIGHTING

TECHNICAL FIELD OF THE INVENTION

This invention relates to sport fighting shields.

BACKGROUND OF THE INVENTION

The present invention relates to bodily protective devices used since ancient times in hand-weapon combat, both in warfare and as a sport. Success or failure in fighting with directly applied manual weapons depends not only on personal strength, skill, and agility, but also on the design of the weapons, both offensive and defensive. In melee sports, as opposed to fencing, the participant often must contend with more than one opponent at a time and the shield becomes an instrument of the utmost importance, both in preventing the opponents from scoring and in enhancing ones own score with judiciously placed shield bashes.

Due to the design of weapons presently used in warfare, many of which are still in developmental stages, use of both hands is required. Protective devices must be either affixed to the means of transportation or strapped to the warriors body. Thus, buckler/shields have not envolved appreciably since medieval times; there is ample cause for improvement both for the melee sports and for civil hostilities where, for political or like reasons, cudgels and shields are indicated rather than firearms.

It might well be noted at this point, to promote better understanding, that the term 'buckle', as used here in 'buckler', means bend or mutilate, as in a buckled automobile fender.

It is, therefore, the principle object of this invention to provide an improved buckler shield both for melee fighters and for those involved in certain types of limited warfare, to be effective both as a defensive and as an offensive weapon, and to be easily removed or replaced on the shield arm without use of the other hand.

It is also an object of this invention to provide a fighting shield simple of manufacture, easy to maintain, and durable under all conditions, which can easily be anchored against the jarring impacts of lances, mauls, or mounted attacks, offering the experienced user the best protection possible in every instance.

Another object is to provide a buckler/shield of planar form that can easily be cut from standard plates of modern high-strength, light-weight material, such as Kevlar®, for use under certain conditions of warfare where other types of protection are either unavailable, ineffective, or proscribed by extreme climatic conditions.

These and other objects will be readily apparent to one experienced in hand-weapon combat, sporting or otherwise, from the specifications, claims, and drawings hereto appended.

SUMMARY OF THE INVENTION

It has now been established that the foregoing objectives and other advantages can be attained in a buckler shield for primary use by melee combatants which has a generally planar surface and a vertically elongated unitary body portion presenting a smoothly contoured periphery; the upper body segment is of a generally triangular form having a curvilinear apex; the intermediate segment has a larger transverse dimension than either the apex or the depending tail segment. The tail segment is also of generally triangular configuration but with its apex downwardly, and it is located off the vertical midline of the shield body, specifically being aligned with or along the forearm-supported side of the shield. The rearward surface of the shield has a hand-gripping means disposed generally above the horizontal midline, and it is located in close proximity to the inside edge of the shield. Also, a forearm-engageable means is mounted on the rearward surface, being spaced apart somewhat from the hand gripping means, while also being positioned about the horizontal midline of the shield body. This makes the assembly slightly top-heavy when it is being displayed in the vertical position. The forearm engaging means is provided with a vertical movement limiting means.

The upper shield segment has its periphery largely enclosed within a U-shaped metallic banding strip that serves to facilitate the sliding-off of overhand cuts or bashes parried by the upper shield edge.

DETAILED DESCRIPTION OF A PREFERRED EMBODIMENT

Figure 1:
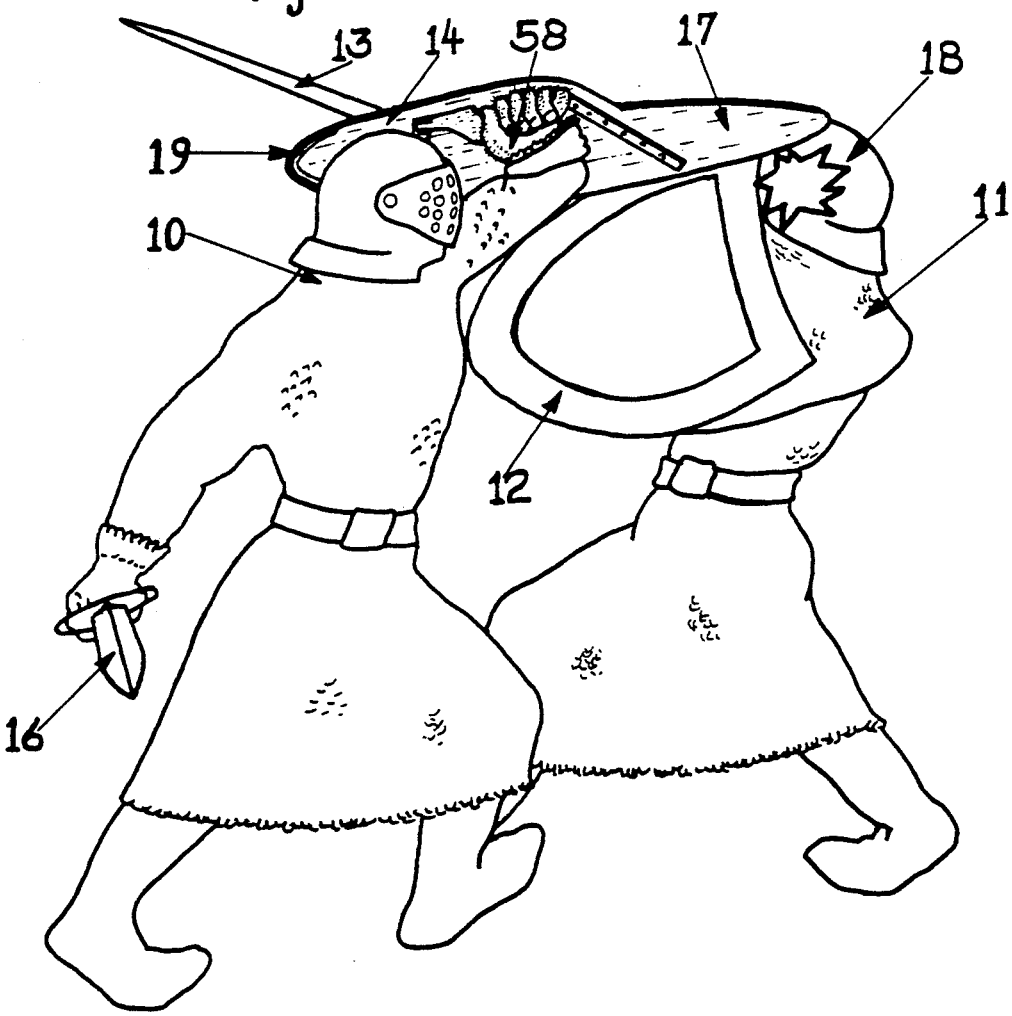
FIG. 1 is a perspective view of two sporting melee fighting combatants scene using swords and shields with one of them employing the Buckler/shield (horizontal position) of the present invention.

Referring now to the drawing in detail, wherein like numerals are designated by like parts, there is first seen a pair of sporting melee combatants 10 and 11 being in FIG. 1, with the rightward side fighter 11 using a broad triangular shield 12 of the prior art. Leftward combatant 10 grips a buckler/shield 14 of the present invention, which is mounted on his left forearm 15, while his free right hand grips a standard broad sword 16. The upraised tail portion 17 of the buckler/shield is seen being employed in a swinging bash motion, or 'swash', on an upward diagonal across the helmet 18 and shield 12 of opponent 11, the present shield 14 having a normally preferably curvilinear segment 19 that has intercepted and now deflects the long sword 13 of the opponent 11 upwardly.

Tail 17 can be employed as well for wedging under the opponent's sword arm, (not seen) behind his shield 12, between his parted legs, or between his gauntlets (not seen) if he is hefting a two-handed weapon.

Some of the other advantages to the user of having a depending tail 17 include capabilities of reaching out to intercept horizontal or low swings by the opponent and the protection afforded his advanced leg when in a kneeling position to defend against lance, missile, or mounted attack.

Figure 2:
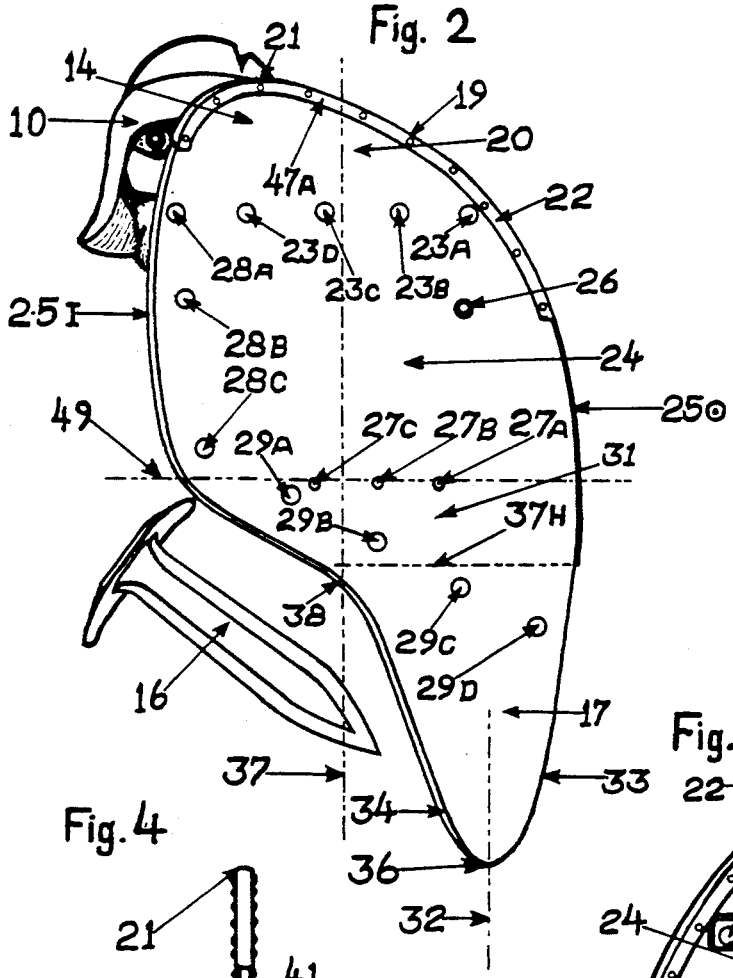
FIG. 2 is a front surface perspective view of the present melee sport fighting shield as assembled for a right-handed user, rotated 10° in the vertical plane for clarity, configured according to the present invention.

In the perspective view of FIG. 2, the present Buckler/shield 14 is seen as it appears to an opponent. Shield 14 has a generally planar surface (FIG. 4?) and is vertically elongated presenting a unitary body having an irregular but smoothly contoured periphery 19. The upper segment 20 of the shield presents a generally triangular configuration, but it is provided with a curvilinear upper apex 21. The shield thickness is about 0.75" throughout. Much of the edging of upper segment 20 is provided with a metal U-shaped banding strip extending down much of the outer vertical side 25O and having a face enclosing side 47A corresponding to a back enclosing side to be shown. Strip 22 facilitates the deflecting of blows from an opponent's weapon 13 (FIG. 1). Arrayed essentially horizontally along the bottom line of upper segment 20 are the heads of evenly spaced rivets 23A, B, C, and D, which pin the unitary body to reversely-located bracing bar, to be described.

The middle body segment 24 has a somewhat variable but larger transverse (horizontal) dimension than upper segment 20. It is provided with substantially parallel but slightly curvilinear lateral sides 25O and 25I. Located proximal to outer vertical side 25O is a counterbored aperture 26 which receives the anchored end of a thong, to be described.

Arrayed essentially horizontally along the phantom bottom line of middle segment 24 are three smaller counterbored holes which provide the anchoring means for bott retaining bolts 27A, 27B, and 27C on the reverse side, to be described. Vertically aligned boltheads 28A, 28B, and 28C anchor gripping means retaining bolts to be described, on the reverse side. The remaining rivet head array, 29A, 29B, 29C, and 29D, is located transversely and inclined downwardly along the upper edge of lower body segment 31. These rivets serve to reinforce the shield body by pinning same to another bracing bar, to be described on the reverse side. Lower depending tail segment 17 (FIG. 1) is of a generally triangular configuration, but also presents curvilinear converging lateral sides 33 and 34, and a well-rounded lower apex 36.

Note that the lower apex portion 36 is located eccentrically of a phantom vertical midline 37 of the unitary body of the shield 14. Outer lateral side 33 of lower segment 17 is essentially aligned with the outer lateral edge 25O of the shield 14.

The common horizontal border of middle segment 24 and of lower segment 17 (phantom line 37H) intersects inner lateral side 34 (of segment 17) at a point which coincides with a concave, somewhat rounded corner, or crotch 38, which performs a meaningful function. Crotch 38 can serve for snaring an opponent's sword before an overhead swing can be attempted, or for locking momentarily on opponent's weapon, while seeking to "bash" with shield head 21 or inside edge 25I.

It can further be used for bashing an opponent's visor while the shield tail is being driven under his arm to deter an overhand stroke. Defensively, it serves also for resting of blade or spear shaft in the kneeling position, when the pommel of one's weapon is braced against the right leg and the tail of shield 14 is grounded, or is resting on one's foot.

Figure 3:
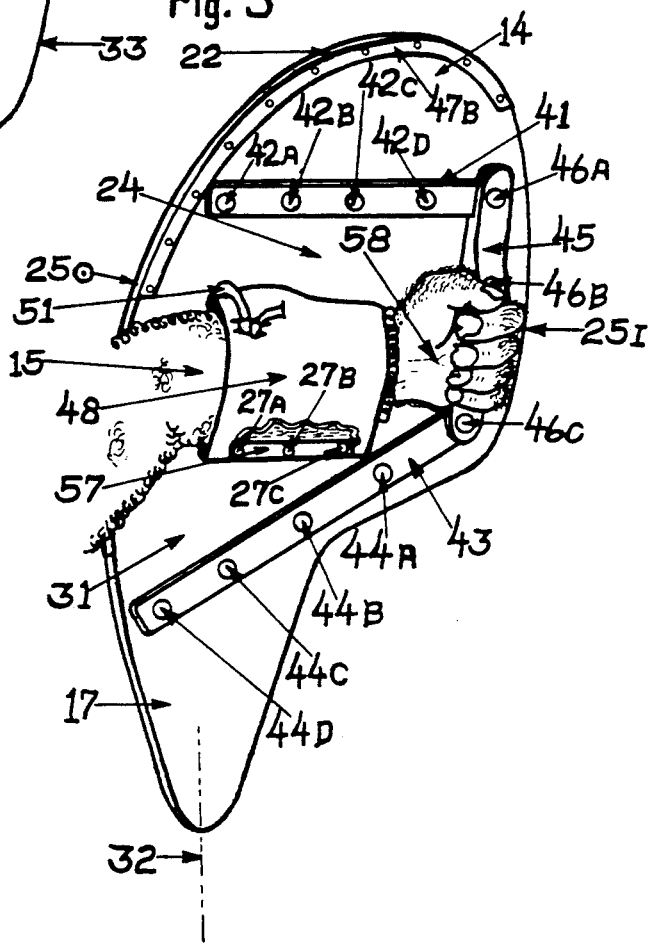
FIG. 3 is the reverse surface, perspective view of the fighting shield of FIG. 2, rotated 10° in the vertical plane for clarity, showing the shield reinforcing means, gripping means, and stabilizing means.

The perspective view of FIG. 3 shows the reverse side as it appears when being supported on the forearm 15 of the combatant with the inventive shield. An upper transverse bracing bar 41 is seen with an array of rivets 42A–D, which correspond to the upper rivet heads 23A–D of FIG. 2. Similarly, a second and longer inclined bracing bar 43 is inclined along the upper line of tail segment 17. Its array of rivets 44A–D correspond to the front-side lower rivet heads 29A–D of FIG. 2.

A standard, rigid, manually-grippable handle 45 is located close to the inner vertical edge 25I of shield 14. It is aligned substantially vertically, being retained by bolts 46A, B, and C, which correspond to the three substantially vertically aligned bolt heads 28A, B, and C of FIG. 2.

Also, the back enclosing side 47B of pinned banding strip 22 is depicted.

An adjustable forearm 15 engaging means 48, or boot, is affixed horizontally on the rearward surface of the mid-segment 24 by boot retaining strip 57 which is threaded to receive screws 27A, B, and C, (FIG. 2). It is spaced apart laterally from gripping means 45, and it is also centered somewhat above the phantom horizontal midline 49 (FIG. 2) of the shield body. This serves to make the shield assembly 14 somewhat top-heavy, when presented in the vertical position for initial defense. Boot 48 has slack or leaway adjustment means which limits rotation of the shield in a vertical plane. This adjustment means solely comprises a thong, the knotted inner end 51 of which is shown and corresponds to the outer longitudinal end 26 of FIG. 2. This means is one of a drawstring providing an adjustable girth for lateral boot 48".

Figure 4:
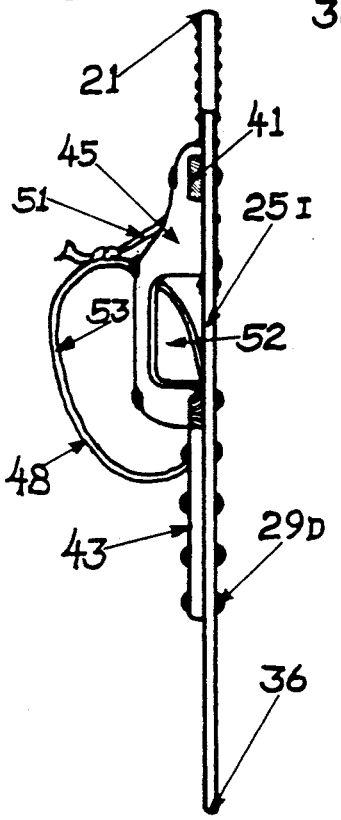
FIG. 4 is a grip side elevational view of the shield of FIGS. 2 and 3 showing the cooperating manual gripping means and boot stabiliziling means.

The configuration and alignment of gripping means 45 and forearm boot 48 are better seen in the side elevational view of FIG. 4. Note the planar surface of the shield assembly, and the rigid, formed handle 45 which is provided with large generally rectangular opening 52 for finger accessing. After adjusting the girth of flexible boot cavity 53 to his personal taste, the fighter will deftly fit his forearm through the sleeve-like boot 48 and then grip handle means 45 with shield hand 58 during engagement and shield manipulation.

Figure 5:
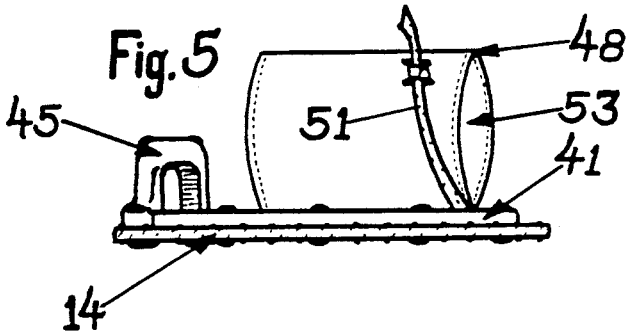
FIG. 5 is a top elevational view of the shield of FIGS. 2, 3, and 4 showing the forearm-embracing boot means as positioned by its adjusting thong.

In the top elevational view of FIG. 5, the juxtaposition of the adjacent boot 48 and gripping handle 45 are better seen. Thong 51 is drawn in or out, as needed, and is temporarily knotted until the next adjustment may be required.

In melee fighting, the present buckler/shield is employed in much the same manner as the known diamond-shaped shield, except that the elegant design and placement of its boot and gripping handle provide exquisite shield control and unparalleled flexibility, as alluded to earlier. Indeed, while the shield tail is braced against the knee or thigh, the hand grip may be released momentarily to adjust helmet visor, check points, and the like. The present shield may be grounded and replaced upon the shield arm without the aid of the sword hand, facilitating rapid weapon changes.

The free-form configuration of this shield makes it more difficult for the opponent to judge and avoid; the smooth periphery and planar surface make it hard to immobilize and thus disable. Being constructed for dynamic usage, it is preferably kept moving during engagement, always protecting, while acting as a threatening accessory against the opponent.

As for shield assembly dimensions and fabrication specifications, the body panels are conveniently made from tough, somewhat soft red oak, with the wood graining aligned vertically with the elongate dimension. The semi-soft body allows for catching and locking of sword or lance points, in order to break weapon blades and shafts, or to dislodge tips, like those of spears and arrows.

For a riot control situation, the shield body could be modified by being cut from 0.820" Kevlar® plate to withstand small high-velocity projectiles. Alternately, the standard oaken shield can be surface-coated with a curable acrylic resin, or the like, for durability and optimal slippage by opposing axes and staves, or the like, wielded by a mob.

The gripping handle 45 can be fashioned from knot-free red oak, and the two bracing strips 41, and 43 also formed of hardened red oak. The boot 48 and associated thong are conveniently manufactured of cowhide—soft treated. Generally, all the wood components should have finishes that are free of burrs, snags, etc., with all edges being smooth beveled, such as of 0.125" radii.

The overall shield elongate length is about 36", with the tail segment 17, as measured from just above the crotch 38 extending downward 15". From the inner lateral edge 25I to a phantom offset vertical line 32 bisecting the depending tail segment 17, it is about 15", with the maximum horizontal dimension of the middle segment 24 being about 19". The two bracing strips 41, and 43, are 2" wide by 0.75" thick, with the upper horizontal one about 15" long, and the lower inclined strip being about 19" long. The gripping means 45 has an overall length of 14" and gripping opening 52 is of 5"×2", being smoothly cornered. It is perhaps one inch in thickness. Gripping element 45 projects backwardly from the shield rearward surface about 2.75".

It will be apparent that the shield is of a dimensional size adapted to protect the body of the combatant when the shield is positioned to face an attack, and also serves to protect the combatant's extremities against blunt trauma occurring upon the impacting of the opponent's blows on the shield.

The present invention has been described with reference to one specific embodiment thereof. Such embodiment should not be viewed as a limitation on the scope of the present invention, with such scope should be ascertained by the following claims.

I claim:

1. A buckler-shield assembly for use by a sporting melee combatant, comprising:

(a) a generally planar surface with a vertically elongated unitary body having an irregular but smoothly contoured periphery, further comprising:

(i) an upper segment of a unitary body presenting a generally triangular configuration having a substantially curvilinear upper apex;

(ii) a contiguous intermediate body segment having a variable but transverse dimension larger than said upper segment and having substantially parallel lateral sides;

(iii) an integral depending tail segment also of a generally triangular configuration presenting a substantially curvilinear lower apex, which apex is located eccentric of a vertical midline of the unitary body but being essentially aligned with an outward lateral side of the shield;

(iv) a rigid manually grippable means affixed to a rearward surface of the unitary body and centered somewhat above a horizontal midline of said body shield, but also being proximal to the inward lateral side thereof; and, (v) a forearm engagable means affixed on a rearward surface of said intermediate segment with its longitudinal axis being spaced apart laterally from the manually grippable means, and also being centered near the horizontal midline of the shield body, thereby making the shield assembly somewhat top-heavy when presented in a vertical position for initial defense.

2. The protective shield assembly of claim 1 wherein the manually grippable means is an essentially vertically-aligned hand-gripping bar pinned securely to the rearward surface of the shield body and which is aligned substantially vertically and proximal to the inward lateral side of the body mid-segment.

3. The protective shield of claim 1 wherein the arm-engageable means comprises a sleeve-like, appendage pinned to the rearward surface and is further provided with an adjustment feature for varying the vertical movement of the sleeve, about the forearm.

4. The protective shield assembly of claim 1 wherein the shield is provided with dimensional size adapted to protect the body of the combatant when the shield is positioned to face an attack and serving to protect the combatant's forward extremities against blunt trauma occurring upon the impacting of the opponent's blows on the shield.

5. The protective shield assembly of claim 1 wherein the shield body is fabricated of a wood material of a softness sufficient to accept and ensnare sword or lance points in order to break off or dislodge their tips.

6. The protective shield assembly of claim 1 wherein the shield body exterior is coated with a polymeric material providing a projectile penetration-resistant facade which will resist axe cuts and deflect projectiles encountered in mob-control activities.

7. The protective shield assembly of claim 1 wherein the depending tail segment is sufficiently elongated to permit its firmly resting and pivoting against the combatant's forwardly disposed knee when defending against sword thrusts and lance attacks.

8. The arm engageable means of claim 3 wherein the sleeve-like appendage has an adjustable girth.

9. A buckler-shield assembly for use by a sporting melee combatant, comprising:

(a) a generally planar surface with a vertically elongated unitary body having an irregular but smoothly contoured periphery, further comprising:

(i) an upper segment of the unitary body presenting a generally triangular configuration having a substantially curvilinear upper apex;

(ii) a contiguous intermediate segment of said body having a variable but transverse dimension larger than said upper segment and having substantially parallel lateral sides; and (iii) an integral depending tail segment of said body also of a generally triangular configuration presenting a substantially curvilinear lower apex, which apex is located eccentric of a vertical midline of the unitary body but being essentially aligned with an outward lateral side of the shield;

(iv) an enlarged rigid, manually-grippable means affixed to a rearward surface of the unitary body; and (v) a flexible forearm-engageable sleeve affixed on the rearward surface of said shield intermediate segment with its inward edge being spaced apart laterally from the manually grippable means.

* * * * *